US011015611B2

(12) United States Patent
Xu

(10) Patent No.: US 11,015,611 B2
(45) Date of Patent: May 25, 2021

(54) CENTRIFUGAL IMPELLER

(71) Applicant: Zhongshan Yibisi Technology Co., Ltd., Zhongshan (CN)

(72) Inventor: Haiming Xu, Zhongshan (CN)

(73) Assignee: ZHONGSHAN YIBISI TECHNOLOGY CO., LTD., Zhongshan (CN)

( * ) Notice: Subject to any disclaimer, the term of this patent is extended or adjusted under 35 U.S.C. 154(b) by 60 days.

(21) Appl. No.: 16/686,253

(22) Filed: Nov. 18, 2019

(65) Prior Publication Data

US 2020/0318647 A1 Oct. 8, 2020

(30) Foreign Application Priority Data

Apr. 8, 2019 (CN) ..... 201910275780.3
Apr. 8, 2019 (CN) ..... 201920461576.6

(51) Int. Cl.
*F04D 29/30* (2006.01)
*F04D 29/28* (2006.01)
*F04D 29/02* (2006.01)

(52) U.S. Cl.
CPC ..... *F04D 29/30* (2013.01); *F04D 29/023* (2013.01); *F04D 29/282* (2013.01)

(58) Field of Classification Search
CPC ..... F04D 29/023; F04D 29/282; F04D 29/30; F05D 2240/303; F05D 2240/304
See application file for complete search history.

(56) References Cited

U.S. PATENT DOCUMENTS 4,224,010 A * 9/1980 Fujino ..... F04D 17/122 415/199.2
9,394,913 B2 * 7/2016 Taguchi ..... F04D 29/682
10,865,803 B2 * 12/2020 Woiczinski ..... F04D 29/284
10,865,804 B2 * 12/2020 Mikami ..... F04D 29/30

* cited by examiner

*Primary Examiner* — Ninh H. Nguyen
(74) *Attorney, Agent, or Firm* — Matthias Scholl P.C.; Matthias Scholl

(57) ABSTRACT

A centrifugal impeller includes a base plate, a wheel cover, and a plurality of twisted blades disposed between the base plate and the wheel cover. Every two adjacent twisted blades form an air duct; and each air duct includes an air outlet along an outer edge of the base plate. Each of the plurality of twisted blades includes a leading edge, a trailing edge, an upper edge, and a lower edge. The upper edge and the lower edge are disposed between the leading edge and the trailing edge, and are opposite to each other. Defining an axis of the device as L1, and a plane passing through the axis L1 of the device as a meridional plane, when the twisted blades rotate around the axis L1, the leading edge intersects with the meridional plane to produce a plurality of intersection points on the meridional plane which form a first curve.

20 Claims, 15 Drawing Sheets

CENTRIFUGAL IMPELLER

CROSS-REFERENCE TO RELAYED APPLICATIONS

Pursuant to 35 U.S.C. § 119 and the Paris Convention Treaty, this application claims foreign priority to Chinese Patent Application No. 201910275780.3 filed Apr. 8, 2019, and to Chinese Patent Application No. 201920461576.6 filed Apr. 8, 2019. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND

Centrifugal impellers are key components of centrifugal compressors, a sub-class of dynamic axisymmetric work-absorbing turbomachinery.

Conventionally, a centrifugal impeller includes a base plate, a wheel cover, and a plurality of blades. The base plate and the wheel cover are provided with locating holes, and the blades are provided with locating blocks. The locating blocks are welded in the locating holes to install the blades on the base plate and the wheel cover. The blades are designed based on two-dimensional flow theory. A boundary layer separation effect occurs on the pressure surface or the suction surface of the blades in the air inlet, which adversely affects the flow of the air in the channel, leading to excessive noise.

SUMMARY

The disclosure provides a centrifugal impeller comprising a plurality of twisted blades based on three-dimensional flow design.

A centrifugal impeller comprises a base plate, a wheel cover, and a plurality of twisted blades disposed between the base plate and the wheel cover. Every two adjacent twisted blades form an air duct; and each air duct comprises an air outlet along an outer edge of the base plate. Each of the plurality of twisted blades comprises a leading edge, a trailing edge, an upper edge, and a lower edge; the upper edge and the lower edge are disposed between the leading edge and the trailing edge, and are opposite to each other.

Defining an axis of the device as L1, a plane passing through the axis L1 of the device as a meridional plane A; when the twisted blades rotate around the axis L1, the leading edge intersects with the meridional plane A to produce a plurality of intersection points on the meridional plane A which form a first curve L2; defining a distance from each point of the first curve L2 to the axis L1 as a diameter D0, in an angle of view from the air inlet, the diameter D0 first continuously decreases and then continuously increases.

The trailing edge comprises a distal end with respect to the axis L1; when the distal end rotates around the axis L1, a circle is formed, and a cylindrical surface comprising the circle is defined B; defining the axis L1 as a projection light source, the trailing edge is projected on the cylindrical surface B to form a second curve L3; the second curve L3 comprises five inflection points a, b, c, d, e, take a first line through the inflection point a as an X axis, and a second line through the inflection point e as a Y axis, coordinates of the five inflection points a, b, c, d, e are as follows: a ($X_a$, $Y_a$), b ($X_b$, $Y_b$), c ($X_c$, $Y_c$), d ($X_d$, $Y_d$), e ($X_e$, $Y_e$), wherein:

$$\frac{y_a}{Y} = 0,\ 0 < \frac{y_b}{Y} < 0.3,\ 0.3 \le \frac{y_c}{Y} < 0.7,\ 0.7 \le \frac{y_d}{Y} \le 0.96,\ \frac{y_e}{Y} = 1;$$

$$\frac{x_a}{X} = 1,\ 1 < \frac{x_b}{X} < 1.5,\ 0.3 \le \frac{x_c}{X} < 1,\ 0 \le \frac{x_d}{X} \le 0.5,\ \frac{x_e}{X} = 0;\ \text{and}$$

$$X = X_a,\ \text{and}\ Y = y_e.$$

The upper edge of the twisted blades comprises a plurality of first protrusions, and the wheel cover comprises a plurality of first mounting holes corresponding to the first protrusions; the lower edge of the twisted blades comprises a plurality of second protrusions, and the base plate comprises a plurality of second mounting holes corresponding to the second protrusions.

The wheel cover comprises a central cylindrical part surrounding the air inlet, a peripheral flanging, and an annular mounting part disposed between the central cylindrical part and the peripheral flanging.

Each of the twisted blades comprises a pressure side and a suction side; the suction side is concave toward to the pressure side to form a plurality of transverse stiffeners arranged at intervals.

The base plate comprises an annular top plate and an annular conical surface connected to the annular top plate and sloping downward with respect to the annular top plate; an outer edge of the annular conical surface comprises a flange; a central part of the annular top plate is depressed to form a platform; the platform comprises a plurality of third mounting holes.

The base plate, the wheel cover and the plurality of twisted blades comprise a metal material.

The twisted blades are formed by metal sheets in equal thickness.

The first protrusions comprise a first root part, a first top part, and two first grooves disposed on both sides of the first root part; the first root part is disposed in the first mounting holes; the second protrusions comprise a second root part, a second top part, and two second grooves disposed on both sides of the second root part; the second root part is disposed in the second mounting holes.

The first root part is rotatably disposed in the first mounting holes, and a rotation angle of the first root part is in the range of 10°-60°; the second root part is rotatably disposed in the second mounting holes, and a rotation angle of the second root part is in the range of 10°-60°.

The ratio of the height H1 of the first grooves to the thickness H2 of the wheel cover is 0.9-1; the ratio of the height H3 of the second grooves to the thickness H4 of the base plate is 0.9-1.

The outer diameter D1 of the base plate and the outer diameter of the wheel cover are equal or unequal.

DETAILED DESCRIPTIONS

Figure 1:
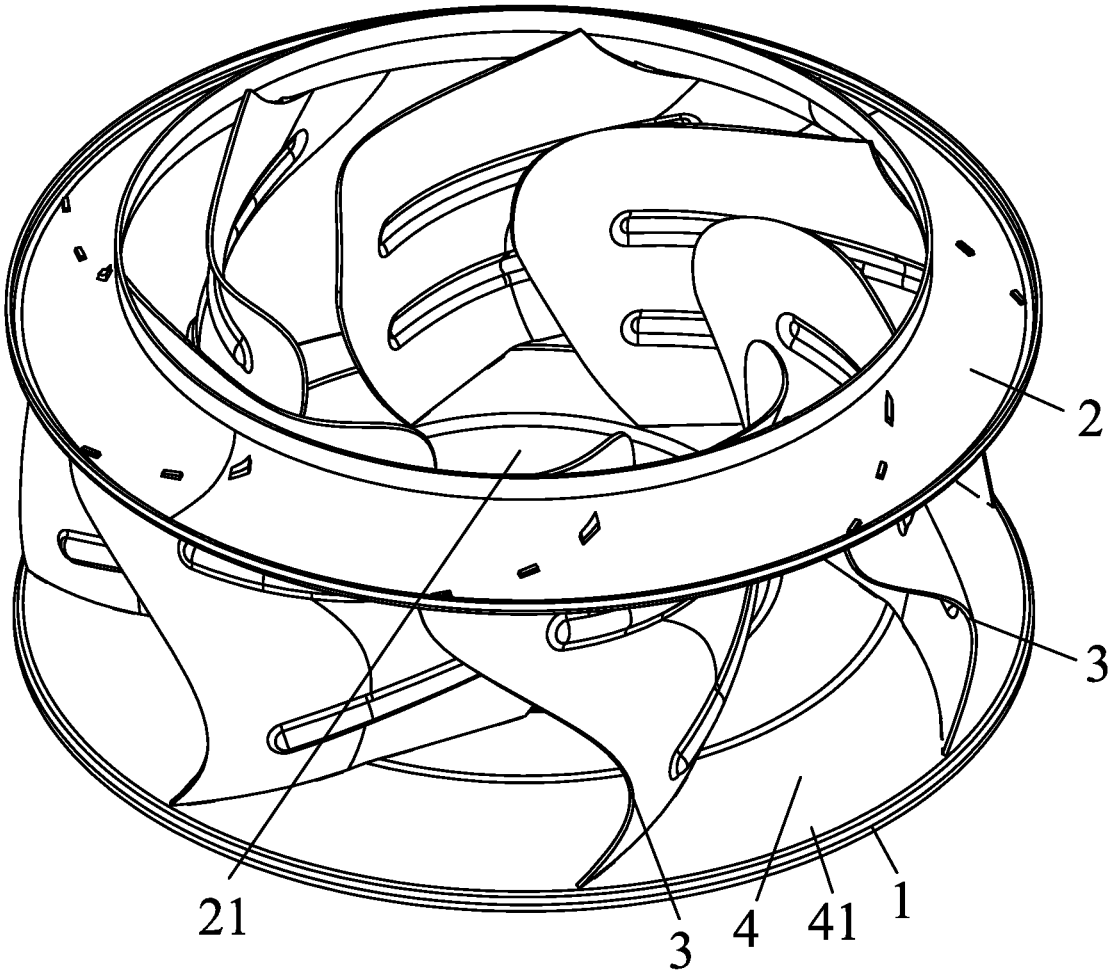
FIG. 1 is a perspective view of a centrifugal impeller according to one embodiment of the disclosure.
Figure 2:
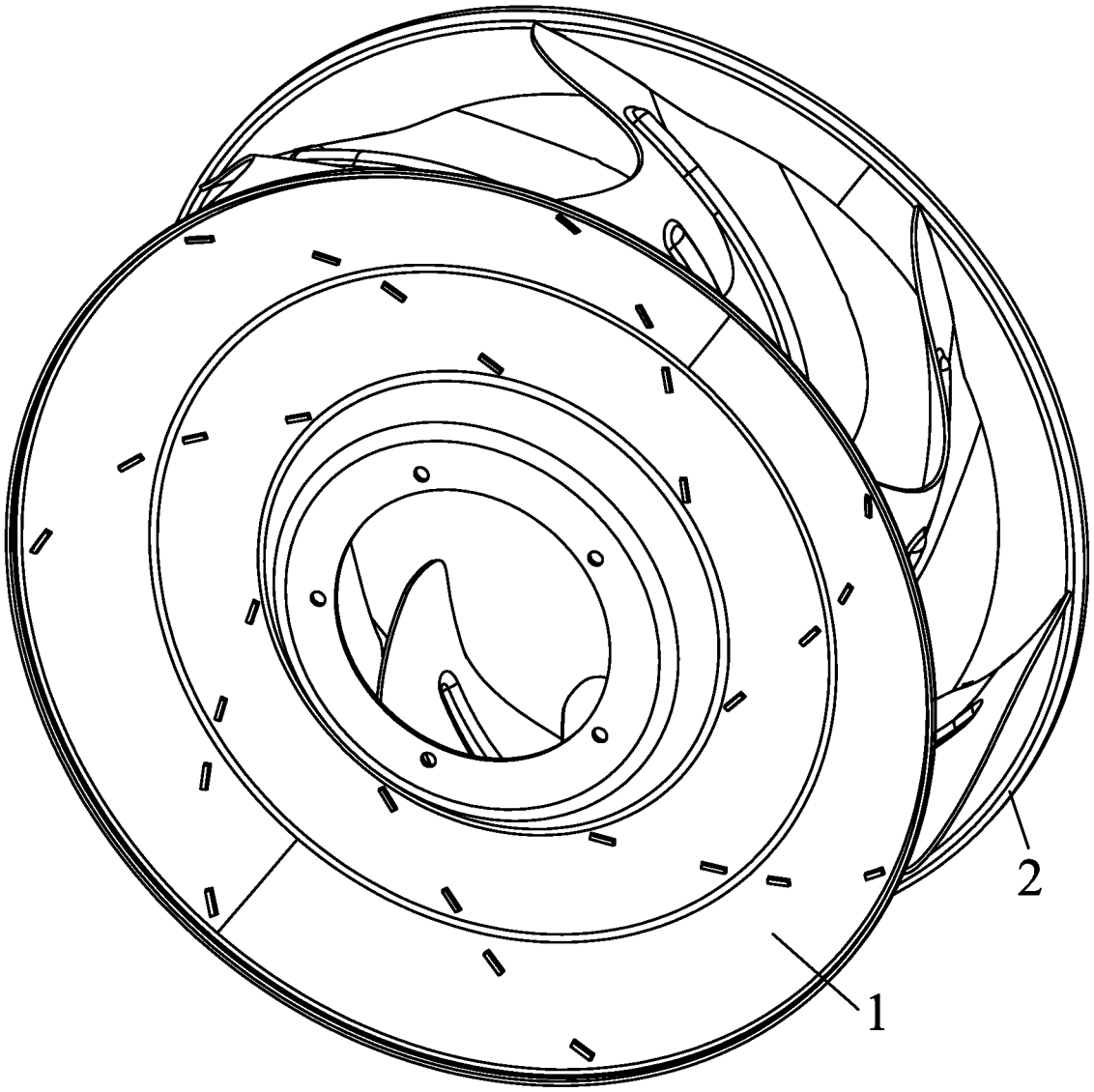
FIG. 2 is another perspective view of a centrifugal impeller according to one embodiment of the disclosure.
Figure 3:
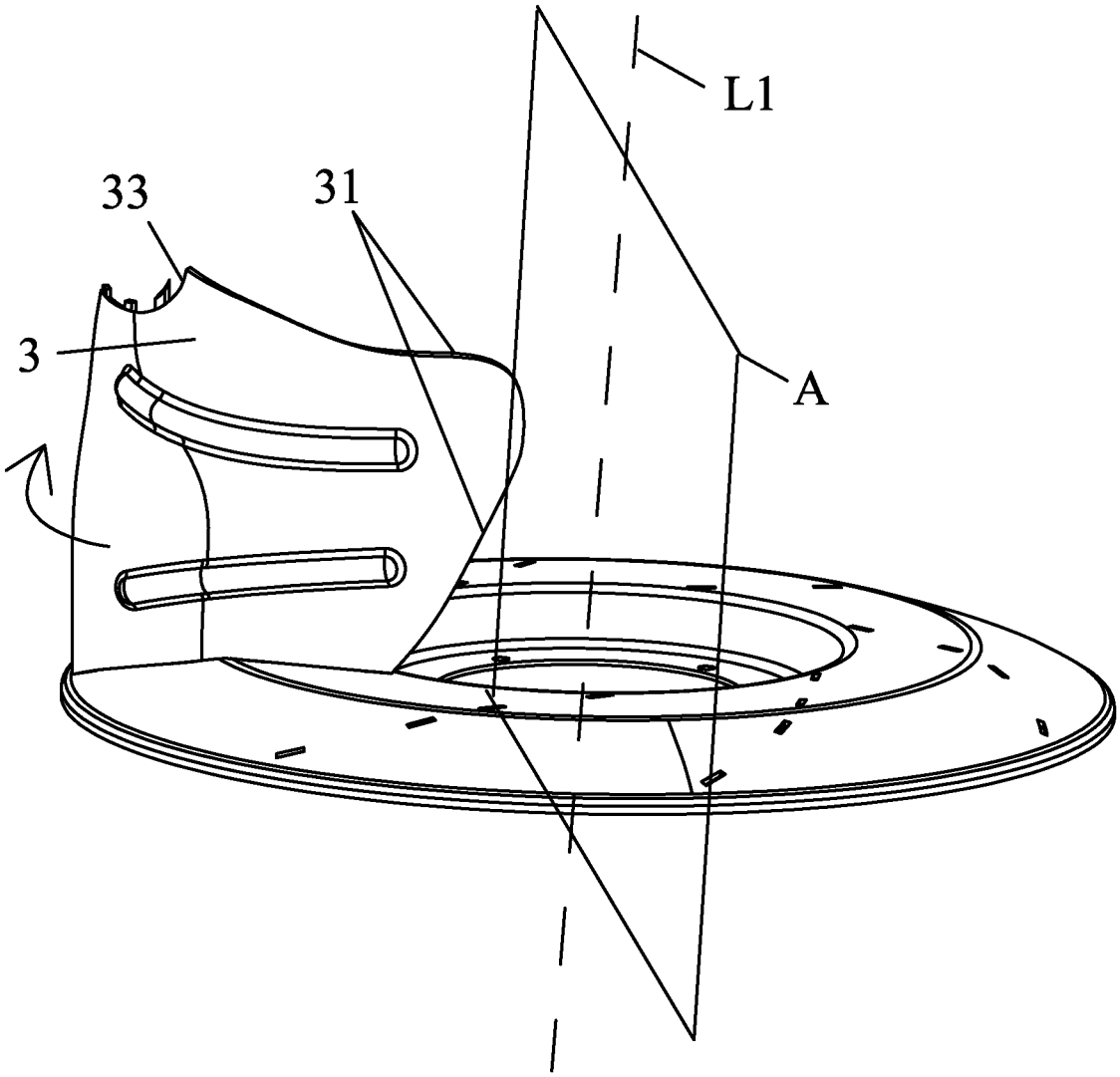
FIG. 3 is a schematic diagram of the meridional plane A according to one embodiment of the disclosure.

To further illustrate, embodiments detailing a centrifugal impeller are described below. It should be noted that the following embodiments are intended to describe and not to limit the disclosure.

As shown in FIGS. 1-15, a centrifugal impeller comprises a base plate 1, a wheel cover 2, and a plurality of twisted blades 3. An air inlet 21 is provided at the center of the wheel cover 2, and a plurality of twisted blades 3 is disposed between the base plate 1 and the wheel cover 2. An air duct 4 is formed between every two adjacent twisted blades 3, and an air outlet 41 is formed at the outer edge of the air duct 4. The twisted blades 3 comprise a leading edge 31, a trailing edge 32, an upper edge 33, and a lower edge 34. The plane passing through the axis L1 of the impeller is called a meridional plane A; when the leading edge 31 rotates along the axis L1, points on the leading edge intersects with the meridional plane A to form a curve L2; the distance from each of points on the first curve L2 of the meridional plane A to the axis L1 of the impeller is called diameter D0. In an angle of view from the air inlet, the straight line D0 is gradually decreased, and then gradually increased; the maximum outer diameter of the trailing edge 32, as a rotating diameter, rotates around the axis L1 of the impeller, to form a cylindrical surface B; all of the points on the trailing edge of the twisted blades are radially irradiated and projected onto the cylindrical surface B, after the emission of light from the impeller axis L1; the projection formed on the cylindrical surface B is unfolded to a planar pattern to form a curve L3, wherein five curvature inflection points are selected on the curve L3, and the coordinates $(X_a, Y_a)$, $(X_b, Y_b)$, $(X_c, Y_c)$, $(X_d, Y_d)$, $(X_e, Y_e)$ of these five points meet the requirements as follows;

$$\frac{y_a}{Y} = 0,\ 0 < \frac{y_b}{Y} < 0.3,\ 0.3 \le \frac{y_c}{Y} < 0.7,\ 0.7 \le \frac{y_d}{Y} \le 0.96,\ \frac{y_e}{Y} = 1;$$

$$\frac{x_a}{X} = 1,\ 1 < \frac{x_b}{X} < 1.5,\ 0.3 \le \frac{x_c}{X} < 1,\ 0 \le \frac{x_d}{X} \le 0.5,\ \frac{x_e}{X} = 0;\text{ and}$$

-continued $$X = X_a,\text{ and } Y = y_e.$$

The angle and the diameter of the leading edge is variable and can be adapted to the air inlet condition, effectively eliminating the formation of the boundary-layer separation at the inlet because of the non-fitting between the gas and the blade profile; the angle and the diameter of the trailing edge is variable and can optimize the gas flow situation in the impeller, effectively preventing the formation of the boundary-layer separation because of the gas diffusion in the air duct; thus, the design optimizes the flow inside the flow path, improves the aerodynamics performance of the impeller, reduces the aerodynamic noise of the impeller.

Figure 4:
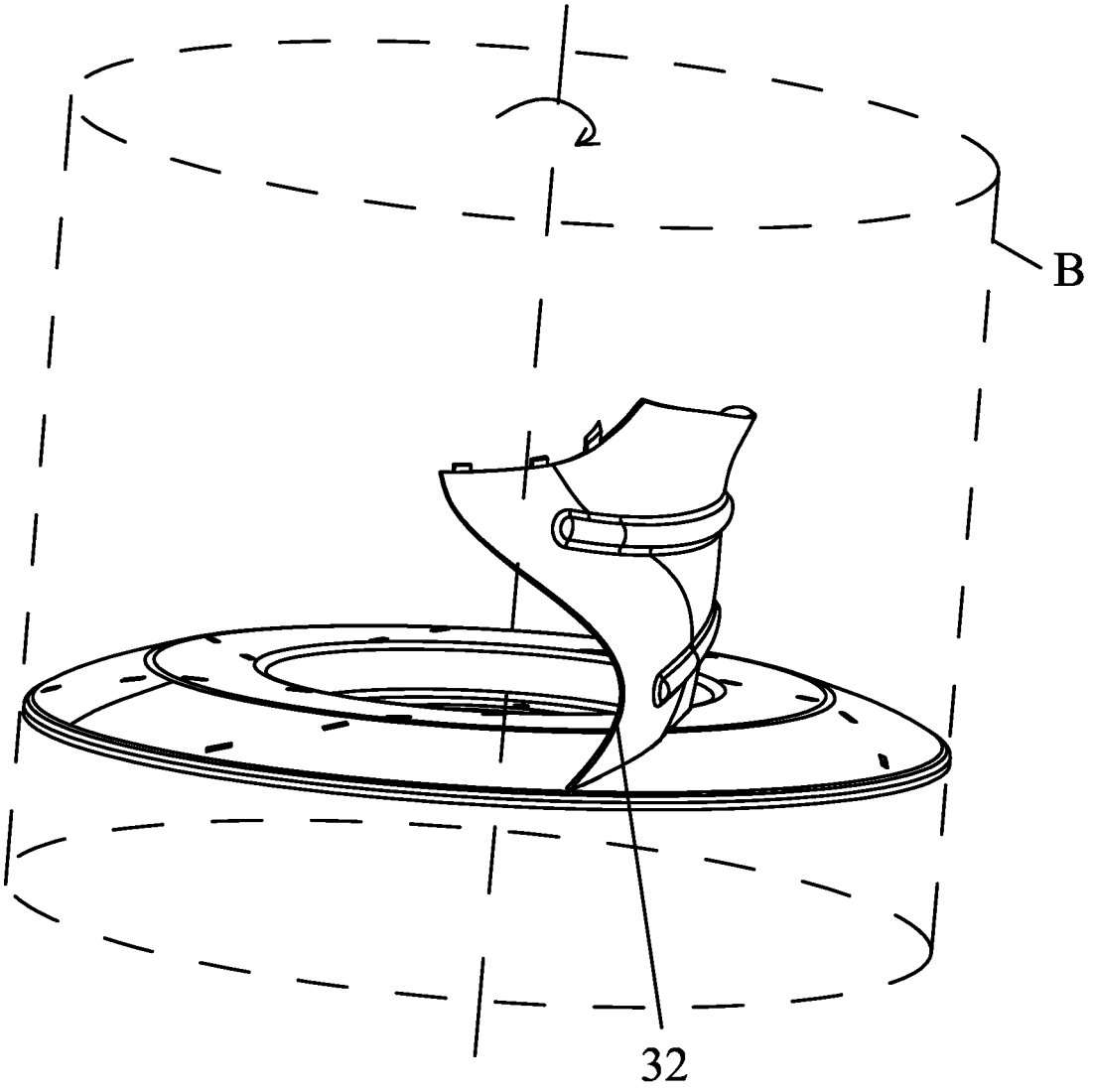
FIG. 4 is a schematic diagram of the cylindrical surface B according to one embodiment of the disclosure.
Figure 5:
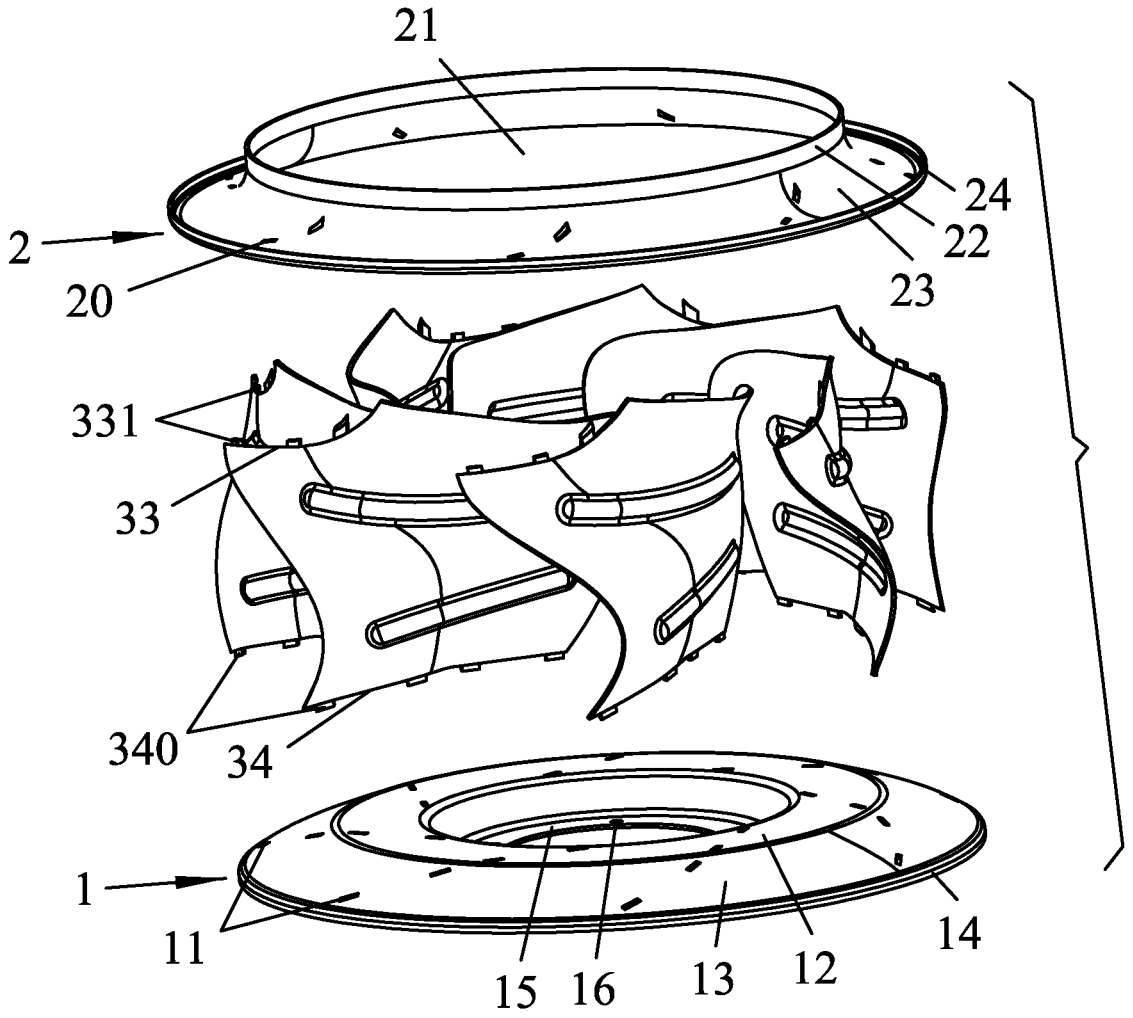
FIG. 5 is an exploded view of a centrifugal impeller according to one embodiment of the disclosure.
Figure 6:
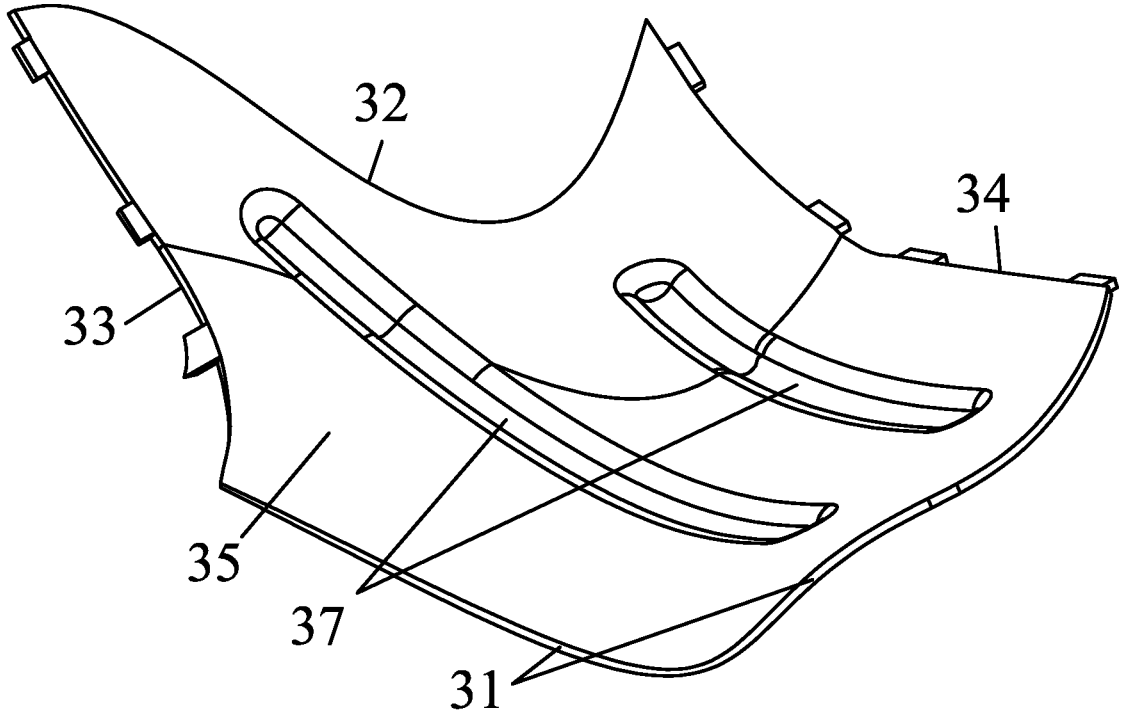
FIG. 6 is a perspective view of the twisted blades according to one embodiment of the disclosure.
Figure 7:
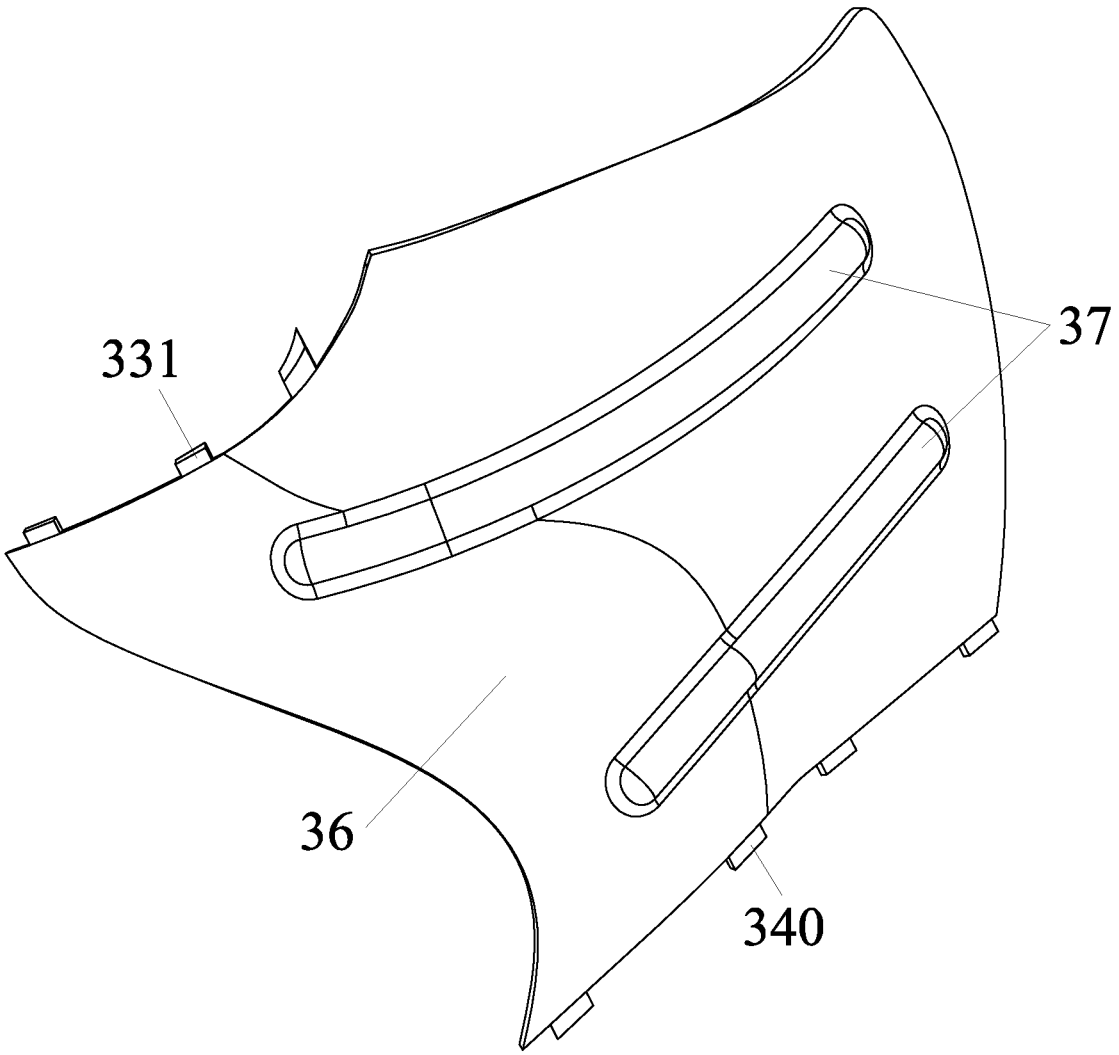
FIG. 7 is another perspective view of the twisted blades according to one embodiment of the disclosure.
Figure 8:
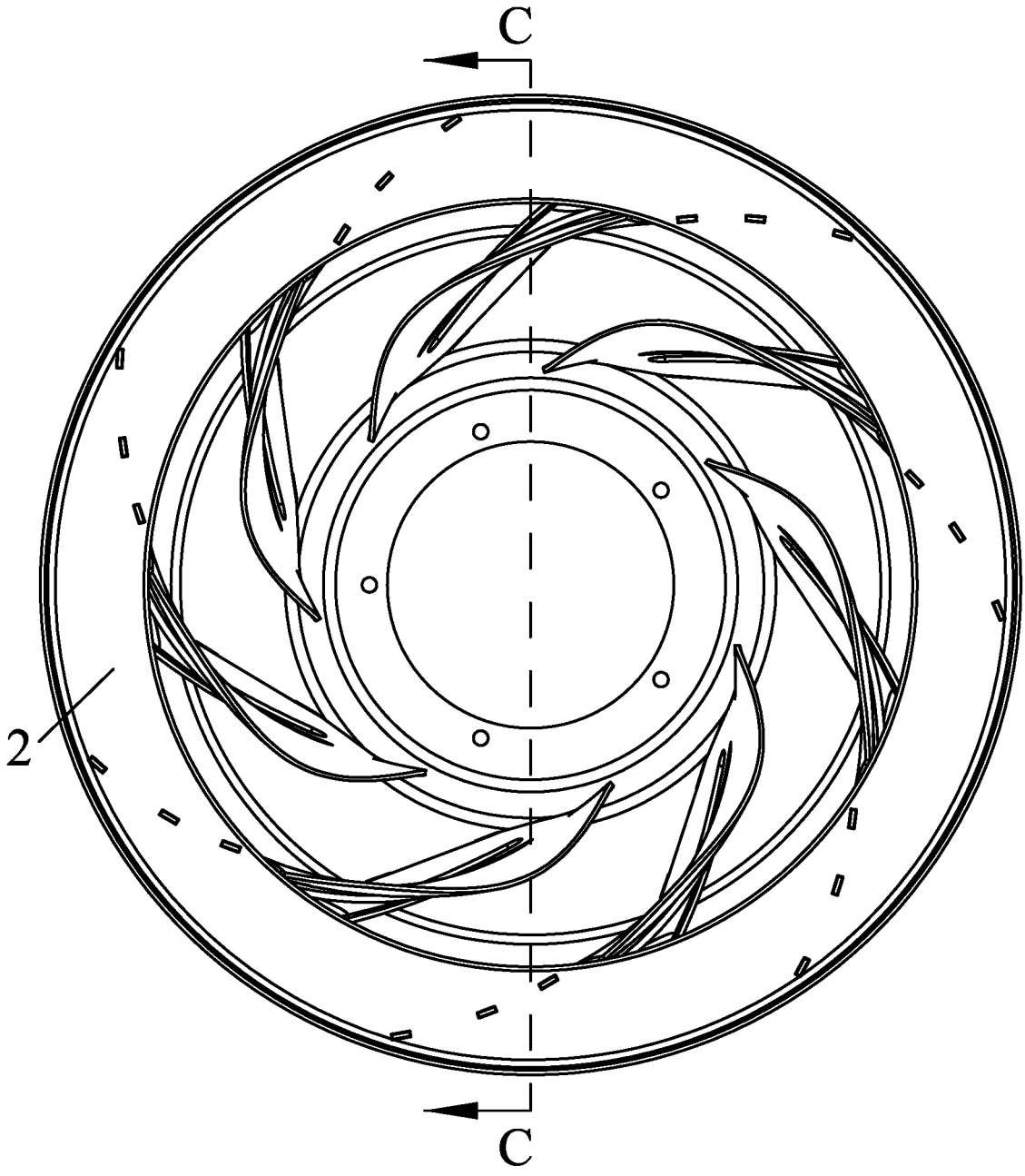
FIG. 8 is a top view of a centrifugal impeller according to one embodiment of the disclosure.
Figure 9:
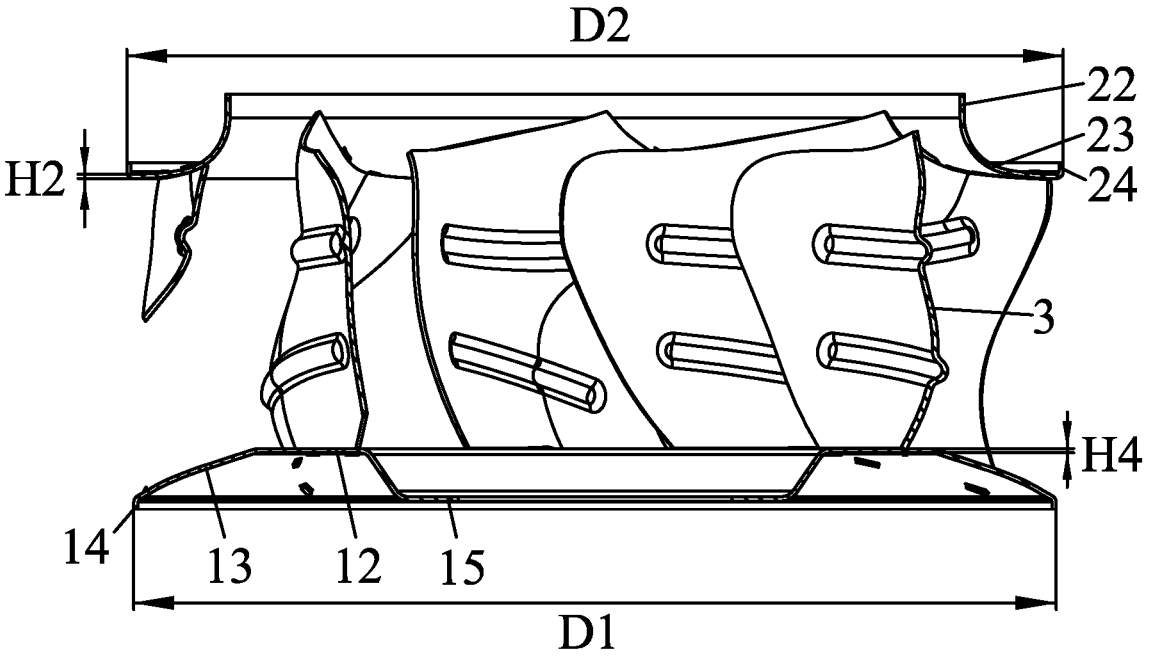
FIG. 9 is a sectional view taken along line C-C in FIG. 8 according to one embodiment of the disclosure.
Figure 10:
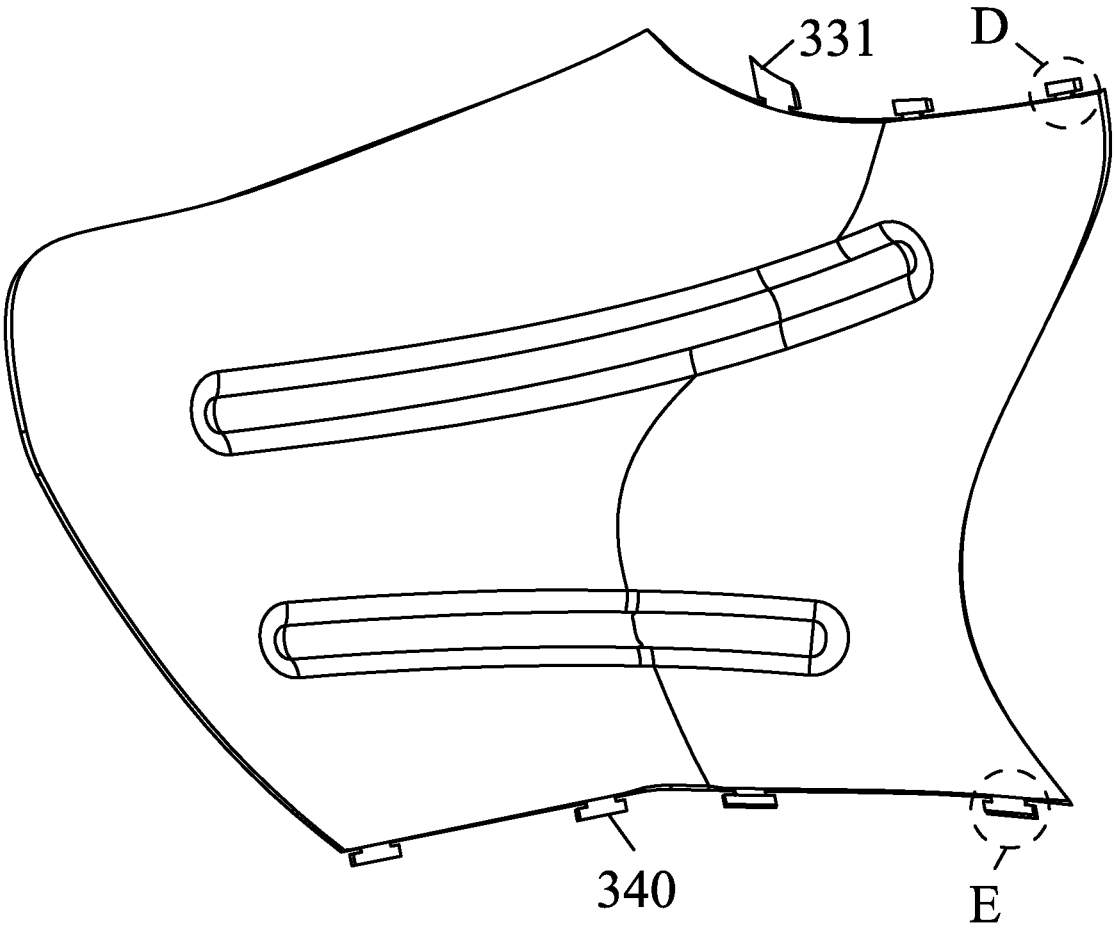
FIG. 10 is a schematic diagram of the blades according to one embodiment of the disclosure.
Figure 11:
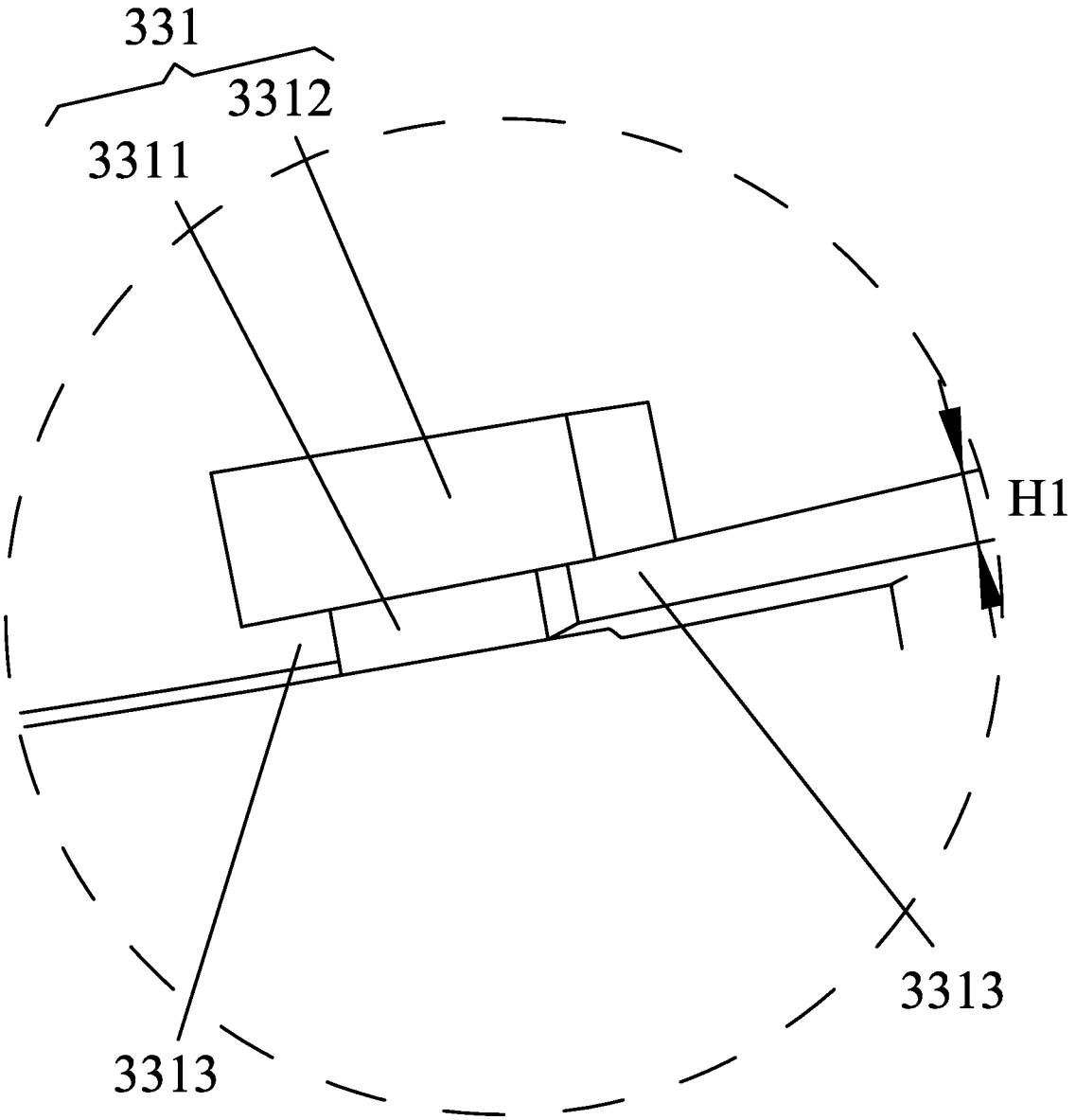
FIG. 11 is a partial enlargement view of D in FIG. 10 according to one embodiment of the disclosure.
Figure 12:
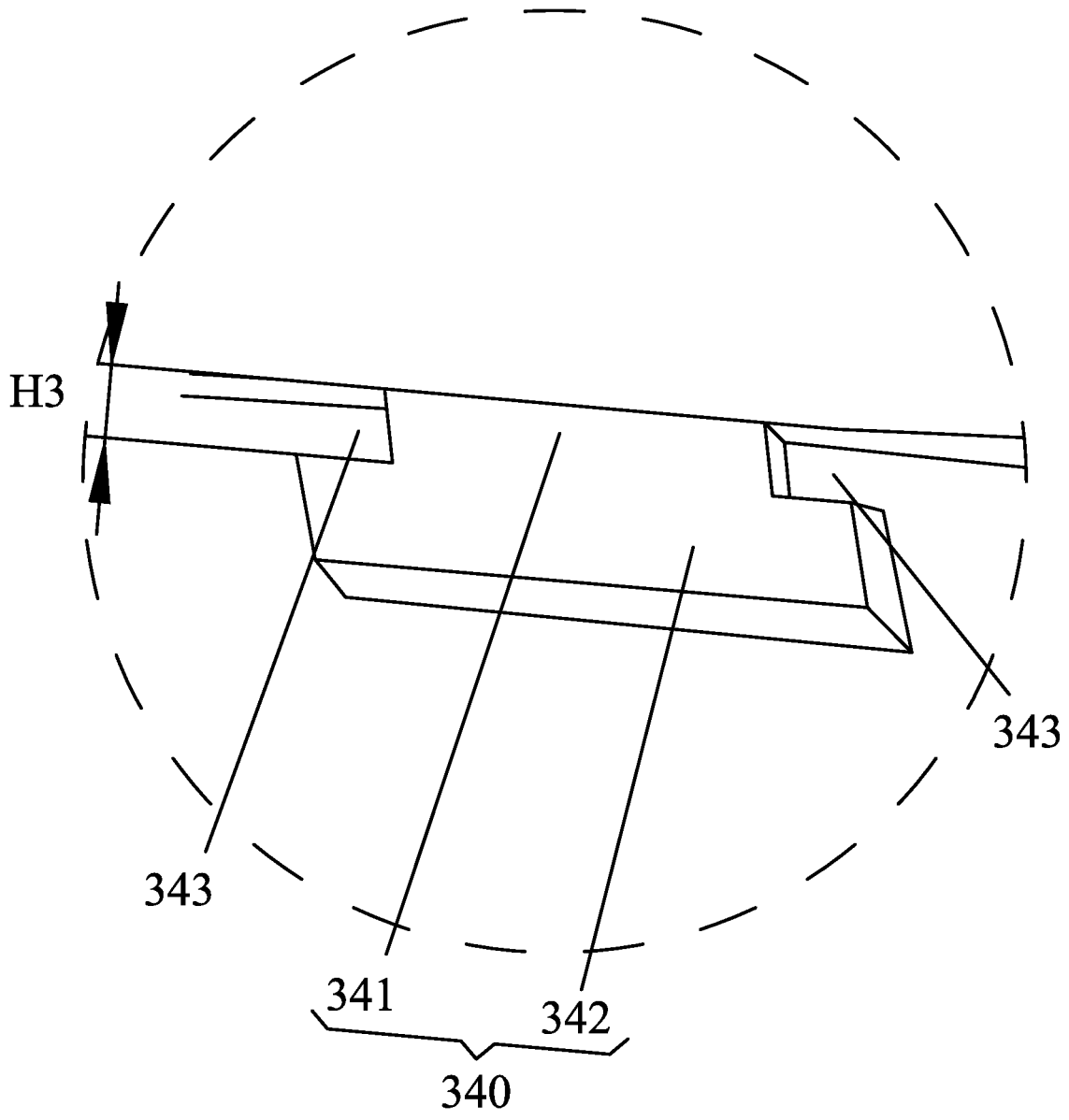
FIG. 12 is a partial enlargement view of E in FIG. 10 according to one embodiment of the disclosure.
Figure 13:
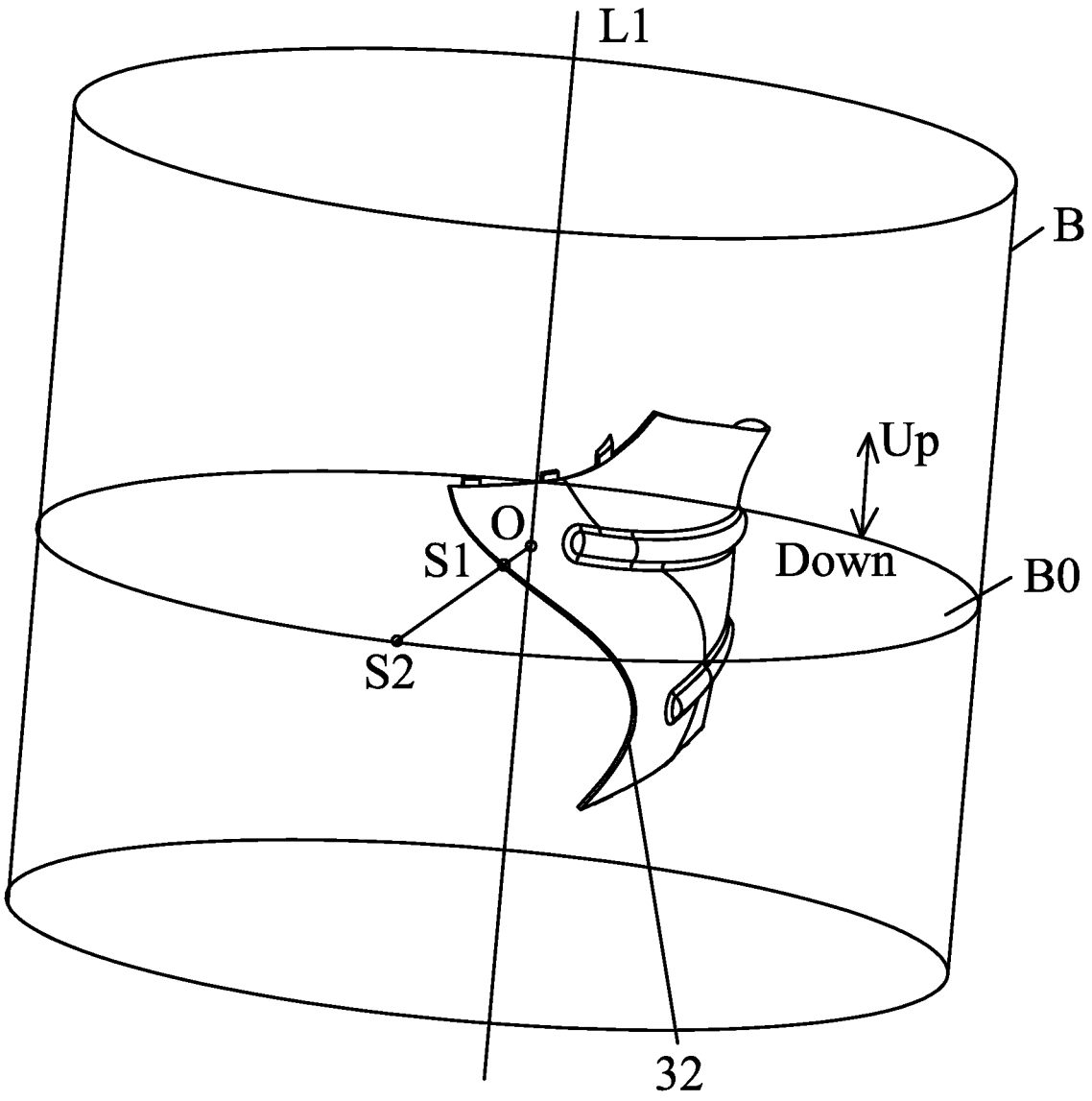
FIG. 13 is a view shows the projection of a point on the trailing edge in the FIG. 4 according to one embodiment of the disclosure.

As shown in FIGS. 4 and 13, defining a section B0 moving up and down along the impeller axis L1 on the cylindrical surface B, when the section B0 moves to a position where the impeller axis L1 intersects with the section B0 to produce an intersection point O as a center of a circle. The section B0 intersects with the trailing edge 32 to produce an intersection point S, and each projection point S1 of the trailing edge 32 is projected onto the cylindrical surface B when the light emitted from the intersection points O radially irradiates to the intersection point S. Therefore, by moving the section B0 up and down along the impeller axis L1, the projection of the points on the trailing edge 32 onto the cylindrical surface B can be obtained. And the projection each of points on the trailing edge 32 on the cylindrical surface B is unfolded to form a curve L3.

Figure 14:
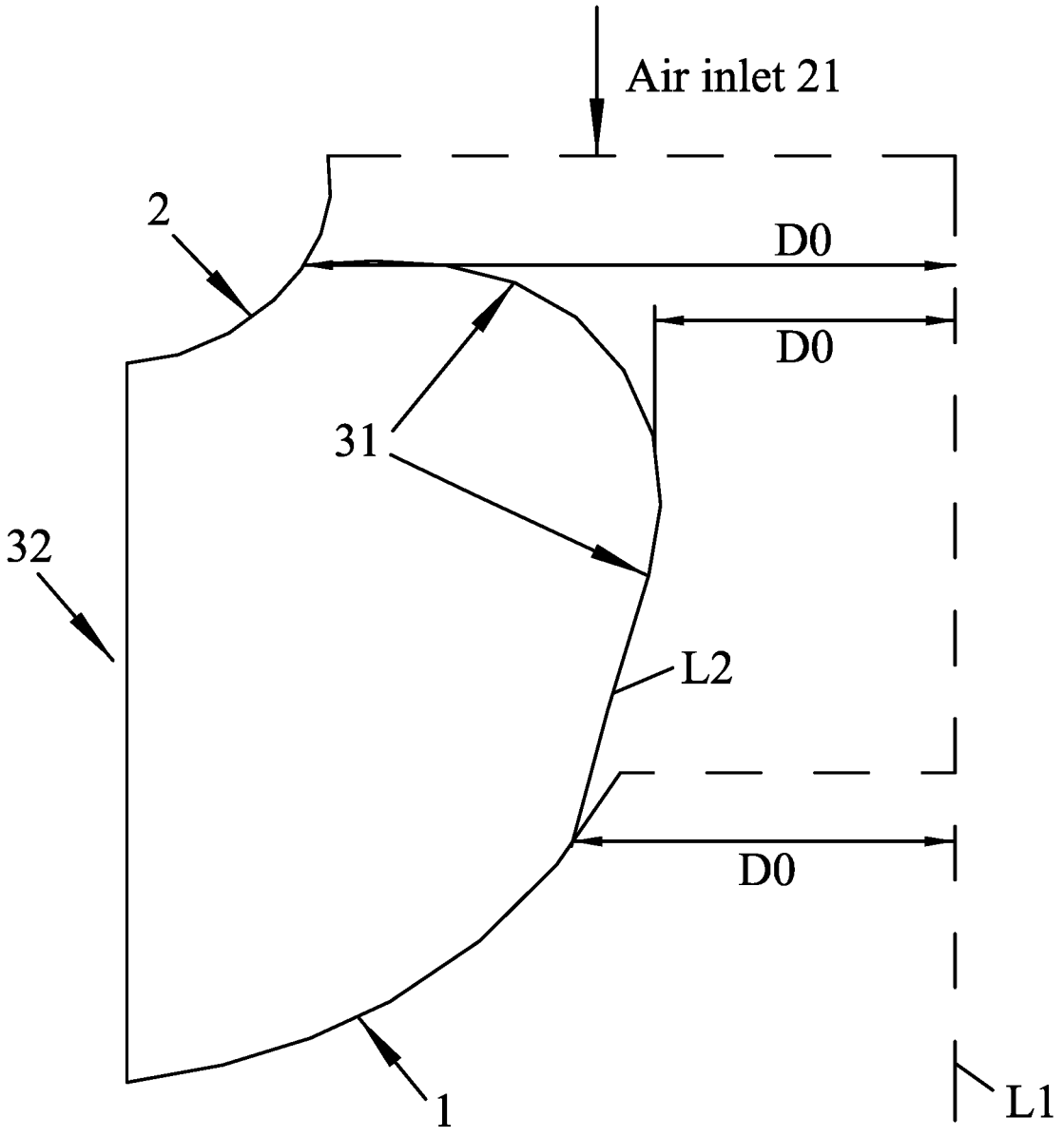
FIG. 14 is a schematic diagram shows the intersection of the leading edge and the meridional plane A according to one embodiment of the disclosure.
Figure 15:
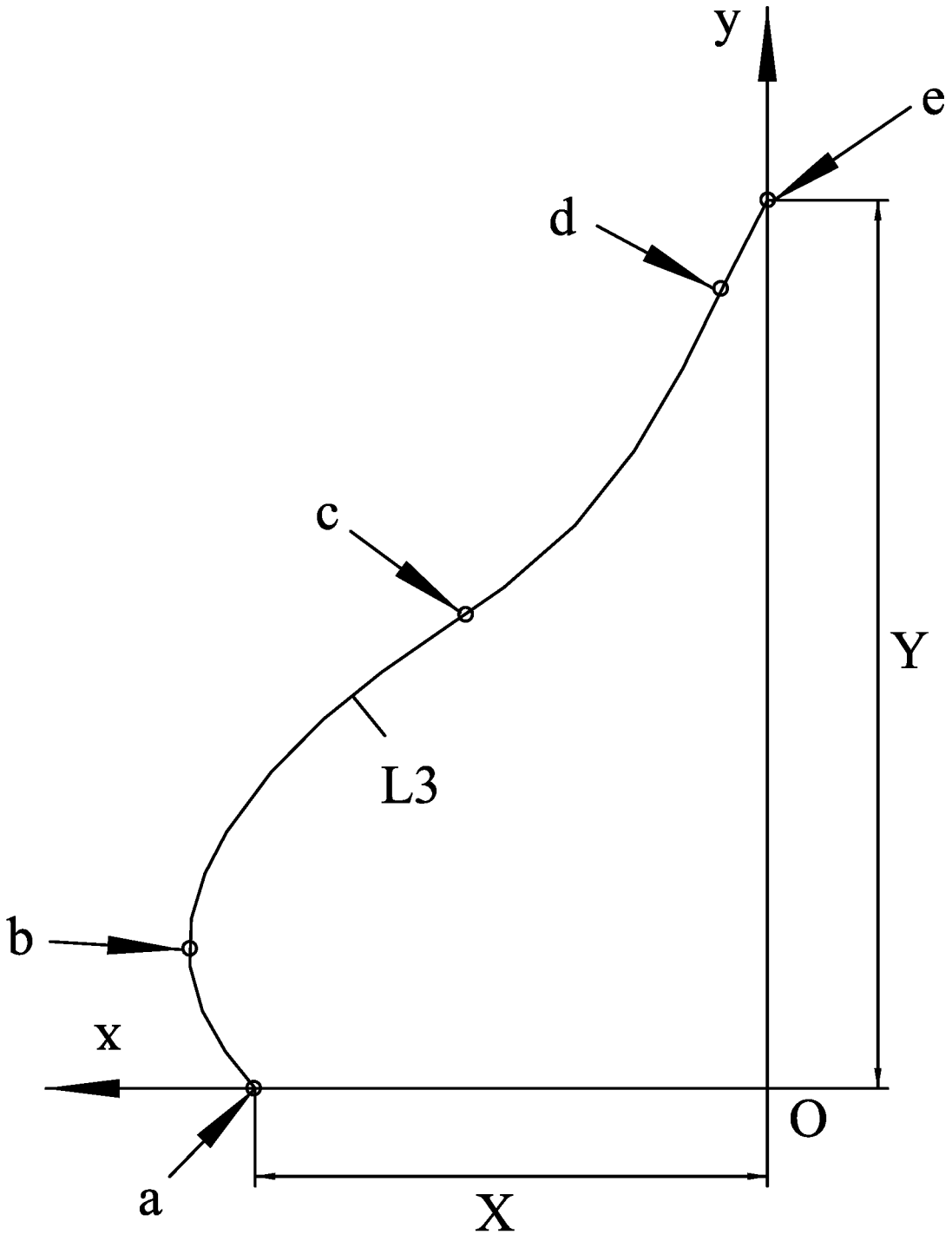
FIG. 15 is an unfolded view showing the projection of each point of the trailing edge onto the cylindrical surface B according to one embodiment of the disclosure.

As shown in FIG. 14, defining a plane passing through the axis L1 of the impeller as a meridional plane A, when the leading edge 31 rotates along the axis L1, each point on the leading edge 31 intersects with the meridional plane A to form a first curve L2; the distance from each points on the first curve L2 of the meridional plane A to the axis L1 of the impeller is called the diameter D0; looking in at the air inlet 21, the straight line D0 is gradually decreased, and then gradually increased. At the leading edge of the impeller, the design vary in the angle and the diameter is adapted to a complex air inlet condition, effectively eliminating the formation of the boundary-layer separation at the inlet due to the non-fitting between the gas and the blade profile.

The upper edge 33 of the twisted blades 3 comprises a plurality of first protrusions 331, and a plurality of mounting holes 20 corresponding to the position of the first protrusions 331 are provided on the wheel cover 2. The first protrusions 331 can insert into the first mounting holes 20, thus realizing the connection of the upper edge 33 and the wheel cover 2; the lower edge 34 of the twisted blades 3 comprises a plurality of second protrusions 340, and the second mounting holes 11 corresponding to the position of the second protrusions 340 are provided on the base plate 1. The second protrusions 340 can insert into the second mounting holes 11, thus realizing the connection of the lower edge 34 and the base plate 1. The entire structure is easy to install and position, and the axial, radial and circumferential positioning can be simultaneously realized.

The wheel cover 2 comprises a central cylindrical part 22 surrounding the air inlet 21, a peripheral flanging 24, and an annular mounting part 23 disposed between the central cylindrical part and the peripheral flanging.

Each of the twisted blades 3 comprises a pressure side 36 and a suction side 35; the suction side is concave toward to the pressure side to form a plurality of transverse stiffeners 37 arranged at intervals.

The base plate 1 comprises an annular top plate 12, an annular conical surface 13 connected to the annular top plate and sloping downward with respect to the annular top plate 12; an outer edge of the annular conical surface 13 comprises a flange 14; a central part of the annular top plate 12 is depressed to form a platform 15; the platform 15 comprises a plurality of third mounting holes 16. The design increases the structural strength.

The base plate 1, the wheel cover 2 and the plurality of twisted blades 3 comprise metal materials.

The twisted blades are formed by metal sheets in equal thickness.

The first protrusions 331 comprise a first root part 3311 and a first top part 3312, wherein the first grooves 3313 are disposed on the both sides of the first root part 3311. The first root part 3311 inserts into the first mounting holes 20 and then the riveting can be realized by rotating the first top part 3312 within a certain angle. The second protrusions 340 comprise a second root part 341 and a second top part 342, wherein the second grooves 343 are disposed on the both sides of the second root part 341. The second root part 341 inserts into the second mounting holes 11 and then the riveting can be realized by rotating the second top part 342 within a certain angle.

The first root part 3311 inserts into the first mounting holes 20, followed by the rotating of the first top part 3312, and the rotating angular range of the first top part 3312 relative to the first root part 3311 is 10°-60°; the second root part 341 inserts into the second mounting holes 11, followed by the rotating of the second top part 342, and the rotating angular range of the second top part 342 relative to the second root part 341 is 10°-60°. The first root part 3311 is rotated at an angular range, so that the wheel cover 2 and the base plate 1 is tightly combined, improving the waterproof properties.

Compared with the conventional connection methods for the positioning ruler and the impeller, the connection of the base plate 1, the wheel cover 2 and the plurality of twisted blades 3 of the disclosure has the advantages of simultaneously axial, radial and circumferential positioning. In the modified connection method, the rotation operation for the positioning ruler does not require excessive external force, and is easy to operate, and the fastening force is strengthened; the modified connection method removes the technological process such as flattening and welding, and reducing the process cost and improving the processing efficiency.

The ratio of the height H1 of the first grooves 3313 to the thickness H2 of the wheel cover 2 is 0.9-1; the ratio of the height H3 of the second grooves 343 to the thickness H4 of the base plate 1 is 0.9-1. Thus, the base plate 1 and the wheel cover 2 are tightly combined, leaving no gaps and preventing the two parts from moving up and down.

The outer diameter D1 of the base plate 1 and the outer diameter of the wheel cover 2 is equal or unequal. The design can satisfy different machine environment, further increasing the aerodynamic performance of the entire machine.

It will be obvious to those skilled in the art that changes and modifications may be made, and therefore, the aim in the appended claims is to cover all such changes and modifications.

What is claimed is:

1. A device, comprising:

1) a base plate;

2) a wheel cover comprising an air inlet which is disposed in a center of the wheel cover; and 3) a plurality of twisted blades disposed between the base plate and the wheel cover;

wherein:

every two adjacent twisted blades form an air duct; and each air duct comprises an air outlet along an outer edge of the base plate;

each of the plurality of twisted blades comprises a leading edge, a trailing edge, an upper edge, and a lower edge; the upper edge and the lower edge are disposed between the leading edge and the trailing edge, and are opposite to each other;

defining an axis of the device as L1, and a plane passing through the axis L1 of the device as a meridional plane A, when the twisted blades rotate around the axis L1, the leading edge intersects with the meridional plane A to produce a plurality of intersection points on the meridional plane A which form a first curve L2;

defining a distance from each point of the first curve L2 to the axis L1 to be a diameter D0, in an angle of view from the air inlet, the diameter D0 first continuously decreases and then continuously increases;

the trailing edge comprises a distal end with respect to the axis L1; when the distal end rotates around the axis L1, a circle is formed, and a cylindrical surface comprising the circle is defined B; defining the axis L1 as a projection light source, the trailing edge is projected on the cylindrical surface B to form a second curve L3; the second curve L3 comprises five inflection points a, b, c, d, e, take a first line through the inflection point a as an X axis, and a second line through the inflection point e as a Y axis, coordinates of the five inflection points a, b, c, d, e are as follows: a ($X_a$, $Y_a$), b ($X_b$, $Y_b$), c ($X_c$, $Y_c$), d ($X_d$, $Y_d$), e ($X_e$, $Y_e$), wherein:

$$\frac{y_a}{Y} = 0,\ 0 < \frac{y_b}{Y} < 0.3,\ 0.3 \le \frac{y_c}{Y} < 0.7,\ 0.7 \le \frac{y_d}{Y} \le 0.96,\ \frac{y_e}{Y} = 1;$$

$$\frac{x_a}{X} = 1,\ 1 < \frac{x_b}{X} < 1.5,\ 0.3 \le \frac{x_c}{X} < 1,\ 0 \le \frac{x_d}{X} \le 0.5,\ \frac{x_e}{X} = 0;\ \text{and}$$

$$X = X_a,\ \text{and}\ Y = y_e.$$

2. The device of claim 1, wherein the upper edge of the twisted blades comprises a plurality of first protrusions, and the wheel cover comprises a plurality of first mounting holes corresponding to the first protrusions; the lower edge of the twisted blades comprises a plurality of second protrusions, and the base plate comprises a plurality of second mounting holes corresponding to the second protrusions.

3. The device of claim 1, wherein the wheel cover comprises a central cylindrical part surrounding the air inlet, a peripheral flanging, and an annular mounting part disposed between the central cylindrical part and the peripheral flanging.

4. The device of claim 1, wherein each of the twisted blades comprises a pressure side and a suction side; the suction side is concave toward to the pressure side to form a plurality of transverse stiffeners arranged at intervals.

5. The device of claim 2, wherein each of the twisted blades comprises a pressure side and a suction side; the suction side is concave toward to the pressure side to form a plurality of transverse stiffeners arranged at intervals.

6. The device of claim 3, wherein each of the twisted blades comprises a pressure side and a suction side; the suction side is concave toward to the pressure side to form a plurality of transverse stiffeners arranged at intervals.

7. The device of claim 1, wherein the base plate comprises an annular top plate and an annular conical surface connected to the annular top plate and sloping downward with respect to the annular top plate; an outer edge of the annular conical surface comprises a flange; a central part of the annular top plate is depressed to form a platform; the platform comprises a plurality of third mounting holes.

8. The device of claim 2, wherein the base plate comprises an annular top plate and an annular conical surface connected to the annular top plate and sloping downward with respect to the annular top plate; an outer edge of the annular conical surface comprises a flange; a central part of the annular top plate is depressed to form a platform; the platform comprises a plurality of third mounting holes.

9. The device of claim 3, wherein the base plate comprises an annular top plate and an annular conical surface connected to the annular top plate and sloping downward with respect to the annular top plate; an outer edge of the annular conical surface comprises a flange; a central part of the annular top plate is depressed to form a platform; the platform comprises a plurality of third mounting holes.

10. The device of claim 1, wherein the base plate, the wheel cover and the plurality of twisted blades comprise a metal material.

11. The device of claim 2, wherein the base plate, the wheel cover and the plurality of twisted blades comprise a metal material.

12. The device of claim 3, wherein the base plate, the wheel cover and the plurality of twisted blades comprise a metal material.

13. The device of claim 10, wherein the first protrusions comprise a first root part, a first top part, and two first grooves disposed on both sides of the first root part; the first root part is disposed in the first mounting holes; the second protrusions comprise a second root part, a second top part, and two second grooves disposed on both sides of the second root part; the second root part is disposed in the second mounting holes.

14. The device of claim 11, wherein the first protrusions comprise a first root part, a first top part, and two first grooves disposed on both sides of the first root part; the first root part is disposed in the first mounting holes; the second protrusions comprise a second root part, a second top part, and two second grooves disposed on both sides of the second root part; the second root part is disposed in the second mounting holes.

15. The device of claim 12, wherein the first protrusions comprise a first root part, a first top part, and two first grooves disposed on both sides of the first root part; the first root part is disposed in the first mounting holes; the second protrusions comprise a second root part, a second top part, and two second grooves disposed on both sides of the second root part; the second root part is disposed in the second mounting holes.

16. The device of claim 13, wherein the first root part is rotatably disposed in the first mounting holes, and a rotation angle of the first root part is in the range of 10°-60°; the second root part is rotatably disposed in the second mounting holes, and a rotation angle of the second root part is in the range of 10°-60°.

17. The device of claim 14, wherein the first root part is rotatably disposed in the first mounting holes, and a rotation angle of the first root part is in the range of 10°-60°; the second root part is rotatably disposed in the second mounting holes, and a rotation angle of the second root part is in the range of 10°-60°.

18. The device of claim 15, wherein the first root part is rotatably disposed in the first mounting holes, and a rotation angle of the first root part is in the range of 10°-60°; the second root part is rotatably disposed in the second mounting holes, and a rotation angle of the second root part is in the range of 10°-60°.

19. The device of claim 16, wherein a ratio of a height of the first grooves to a thickness of the wheel cover is 0.9-1; and a ratio of a height of the second grooves to a thickness of the base plate is 0.9-1.

20. The device of claim 18, wherein a ratio of a height of the first grooves to a thickness of the wheel cover is 0.9-1; and a ratio of a height of the second grooves to a thickness of the base plate is 0.9-1.

* * * * *